United States Patent [19]

Sekiya et al.

[11] 4,262,349

[45] Apr. 14, 1981

[54] SYSTEM FOR SIGNALLING THE TERMINATION OF THE LIFETIME OF A BATTERY FOR ELECTRONIC TIMEPIECES

[75] Inventors: Fukuo Sekiya, Tokorozawa; Takashi Yamada, Sayama; Kazunari Kume, Tokorozawa, all of Japan

[73] Assignee: Citizen Watch Co., Ltd., Tokyo, Japan

[21] Appl. No.: 966,063

[22] Filed: Dec. 4, 1978

[51] Int. Cl.[3] ..... G04B 1/26; G04B 25/00

[52] U.S. Cl. ..... 368/66; 368/71; 368/72

[58] Field of Search ..... 585/23 BA, 152 H; 340/636; 368/66, 203, 204

[56] References Cited

U.S. PATENT DOCUMENTS

| | | | |
|---|---|---|---|
| 3,898,790 | 8/1975 | Takamune et al. | 58/152 H X |
| 4,014,164 | 3/1977 | Fujita | 58/152 H |
| 4,074,515 | 2/1978 | Asano | 58/23 BA |

*Primary Examiner*—Vit W. Miska

*Attorney, Agent, or Firm*—Birch, Stewart, Kolasch & Birch

[57] ABSTRACT

A system for signalling the termination of the lifetime of a battery for an electronic timepiece is disclosed. The system includes a hand display device, an electro-optical display device, a battery voltage detecting circuit adapted to produce a signal when voltage of the battery lowers below a predetermined value, and means for modulating the time display pulse to be applied to one of the display devices in response to the signal generated in the battery voltage detecting circuit, thereby to modifying the time display for informing the end of the battery lifetime.

8 Claims, 7 Drawing Figures

SYSTEM FOR SIGNALLING THE TERMINATION OF THE LIFETIME OF A BATTERY FOR ELECTRONIC TIMEPIECES

BACKGROUND OF THE INVENTION

The present invention relates to a system for signalling the termination of the lifetime of a battery for the battery operated electronic timepiece.

There has been proposed a wrist watch having a dual display device comprising a hand display device and an electro-optical digital display device. In such a wrist watch, the time display with hands is easy to read compared with the electro-optical time display. Accordingly, the hand display device is preferably used to display the time and the electro-optical display device is used for other indication, for example as a stopwatch.

SUMMARY OF THE INVENTION

A primary object of the present invention is to provide a system for signalling the termination of the lifetime of a battery for the timepiece having a hand display device and an electro-optical display device. Another object of the present invention is to provide a system which may quickly inform the termination of the lifetime of the battery.

Still another object of the present invention is to provide a system which may signal the termination of the battery lifetime without deterioration of the time display effect.

In accordance with the present invention, there is provided a system comprising a battery voltage detecting circuit adapted to produce a signal when voltage of the battery lowers below a predetermined value, and means for modulating the time display pulse to be applied to one of said display devices in response to said signal from the battery voltage detecting circuit for modifying the time display.

Further object and advantages of the present invention will be more fully understood from the following detailed description taken in conjunction with the accompanying drawings.

DESCRIPTION OF THE PREFERRED EMBODIMENTS

Figure 1:
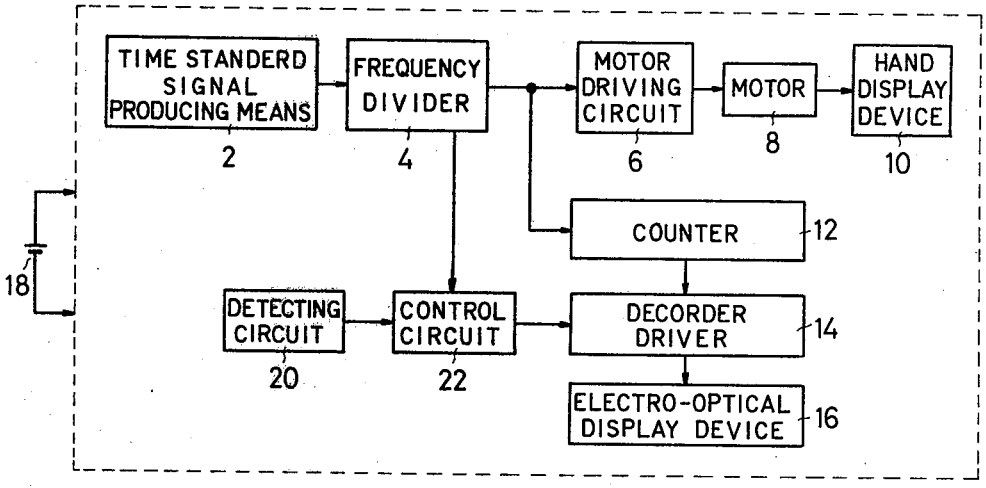
FIG. 1 is a block diagram showing an electronic watch provided with an embodiment of the present invention.

Referring to the drawings and more particularly to FIG. 1 showing an electronic watch provided with an embodiment of the present invention, the electronic watch comprises a time standard signal producing means 2, a frequency divider 4, a motor driving circuit 6, a motor 8, and a hand display device 10. The motor driving circuit 6 produces driving pulses for driving the motor 8 to actuate the hand display device 10 to display the time. A counter 12 counts the output signals of the frequency divider 4 to apply the produced time pulses to a decoder driver 14. The decoder driver 14 produces time display signals to actuate the electro-optical display device 16 to display the time.

The electronic watch is provided with a battery 18 and with a battery voltage detecting circuit 20 which is adapted to produce a signal of high level when voltage of the battery 18 lowers below a predetermined value. The signal is applied to a time display pulse modulating control circuit 22. The time display pulse modulating control circuit is adapted to produce a control signal according to the signal from the detecting circuit 20 and the pulses from the frequency divider 4. The control signal is applied to gate means in the decoder driver 14 to modulate the pulse to be applied to the electro-optical display device 16, whereby the time display may be modified to inform the termination of the lifetime of the battery. In the case that the electro-optical display device 16 is a liquid crystal display device, the control circuit 22 is so arranged to produce pulse signals to control the gate means in the decoder driver 14. Thus, the decoder driver produces an intermittent time signal, so that time display in the device 16 may be flashed. Thus, the termination of the lifetime of the battery may be clearly and quickly indicated.

Figure 2:
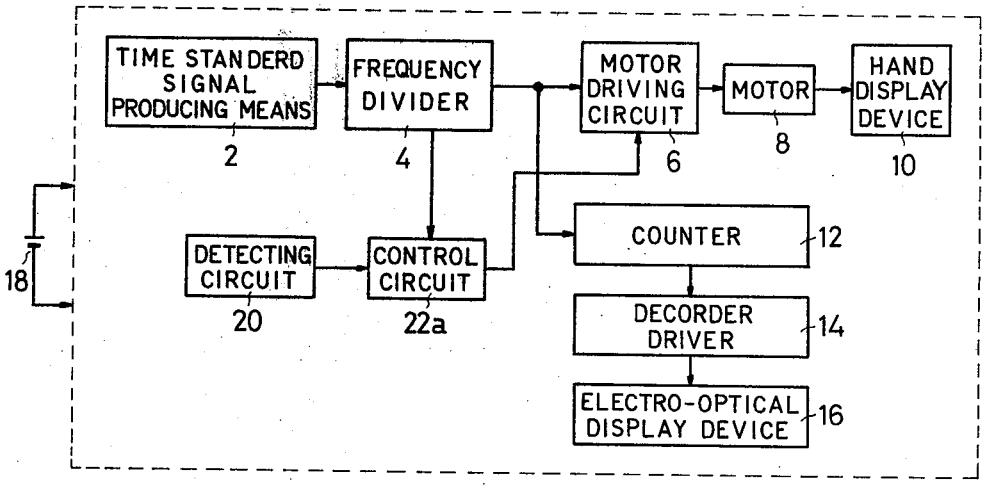
FIG. 2 is a block diagram of an electronic watch having another embodiment of the present invention.

Referring to FIG. 2 showing another embodiment of the present invention, the illustrated electronic watch is same as FIG. 1 in construction. Therefore, the same parts are identified with the same numbers as those of FIG. 1. In this embodiment, a display pulse modulating control circuit **22*a* is connected to the motor driving circuit 6. The control circuit 22*a* is so arranged to modify the advance motion of the second hand in the hand display device 10. It is preferable to modify the advance motion of the second hand, so that modified motion may be clearly distinguished from the original advance motion. For example, such a modified advance motion would include the advancement of the second hand by an angle corresponding to two seconds, the two step intervals of two seconds being distinguishable from the normal advancing motion. Means for performing such a modification of the advance motion of the second hand is disclosed in U.S. Pat. No. 3,998,043. Thus, when voltage of the battery falls below a predetermined level, the display pulse modulating control circuit generates a control signal to modulate the output signal of the motor driving circuit 6, whereby the advance motion of the second hand in the hand display device 10 is modified to inform the termination of the battery. It will be seen that it is possible to have the same effect as in the above embodiments by modifying time displays in both devices 10 and 16**.

Figure 3:
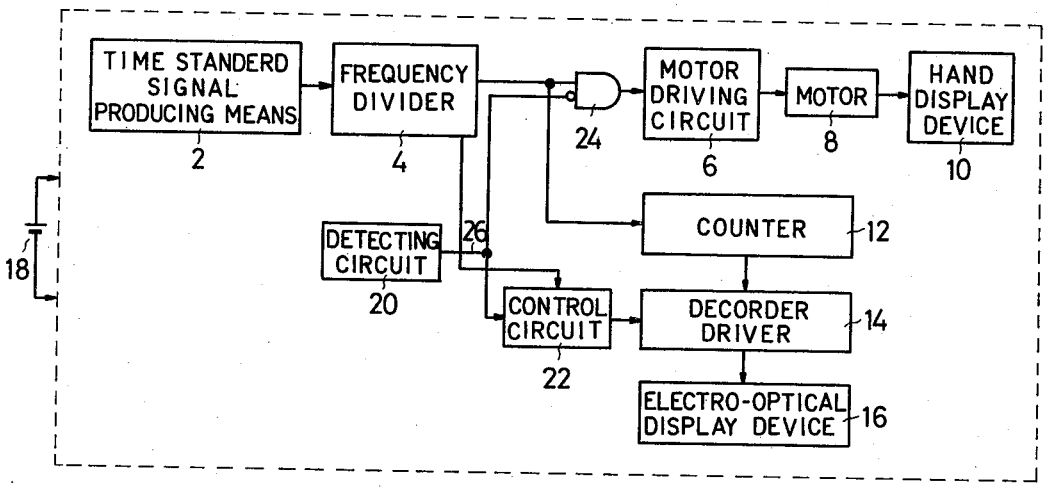
FIGS. 3 to 5 are block diagrams for showing other embodiments, respectively.

Referring to FIG. 3, in this embodiment, the frequency divider 4 is connected to the motor driving circuit through an inhibiter 24 and the battery voltage detecting circuit 20 is connected to the inhibiter 24 and to the display pulse modulating control circuit 22 by a lead 26. When the output signal of the battery voltage detecting circuit 20 is low, both display devices 10 and 16 are actuated, respectively. When the output signal on the lead 26 goes high, the inhibiter 24 turns to the output inhibiting state, whereby the operation of the motor 8 stops. Further, the high level output is applied to the display pulse modulating control circuit 22, which causes the display of the electro-optical display device 16 to modulate, for example to flash as described above.

In accordance with the embodiment of FIG. 3, one of the display devices is turned to non-active state, when the battery voltage lowers to a predetermined level. Therefore, current consumption may be decreased thereby lengthening the lifetime of the battery. Thus, a reliable signalling system may be provided.

Figure 4:
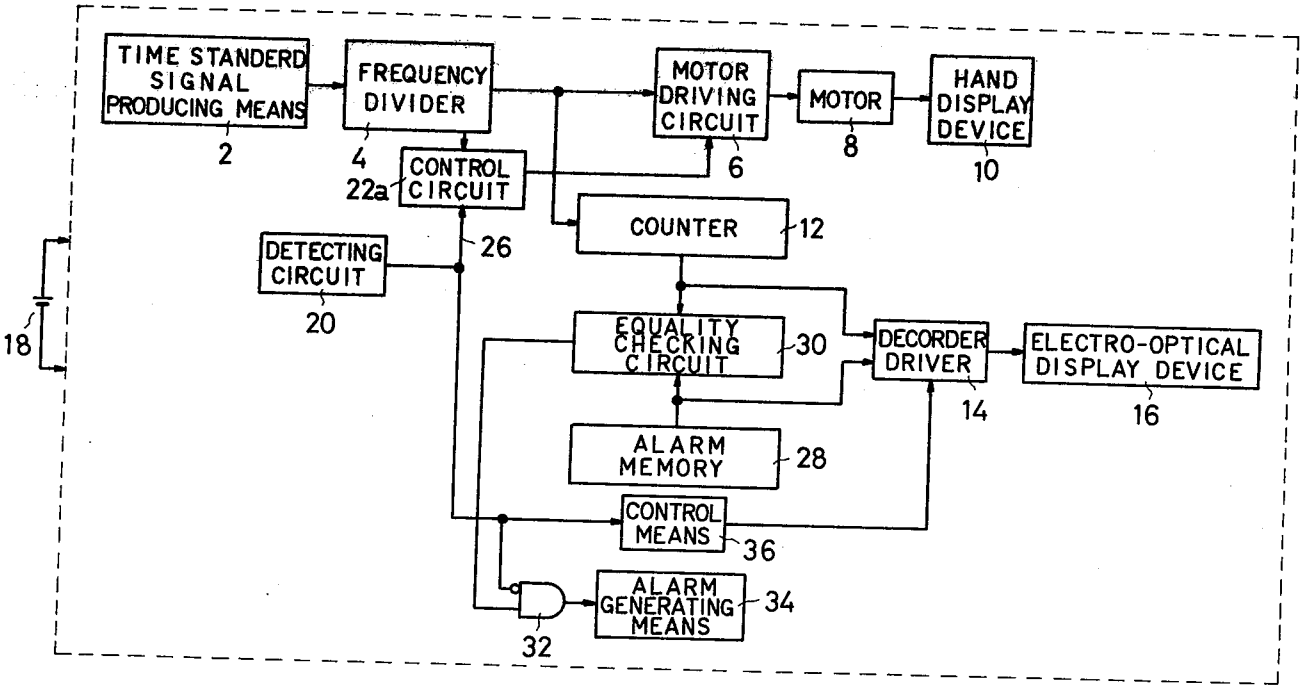

With respect to the embodiment of FIG. 4, the electronic watch is provided with the display pulse modulating control circuit 22a and an alarm means. The alarm means comprises an alarm memory 28, an equality checking circuit 30, an inhibiter 32 and an alarm generating means 34.

In operation, both display devices 10 and 16 are actuated to display the time and others. The contents memorized in the alarm memory 28 may be displayed in the electro-optical display device 16. When the time signal from the counter 12 coincides with the memorized contents, the equality checking circuit 30 produces an output signal of high level. The output signal is applied to the alarm generating means 34 through the inhibiter 32 thereby to generate the alarm.

When the output signal on the lead 26 turns to high level upon the end of the battery lifetime, the high level signal actuates the control means 36 to produce a signal to the decoder driver 14, whereby the driving operation of the decoder driver is terminated. Thus, the display in the electro-optical display device disappears. On the other hand, the display pulse modulating control circuit 22a is also actuated to modify the advance motion of the second hand in the hand display device 10 for signalling the end of the battery lifetime as described above. Further, the high level signal on the lead 26 causes the inhibiter 32 to turn to the output inhibiting state. Therefore, the alarm generating device 34 is not operated by the output signal of the equality checking circuit 30.

Figure 5:
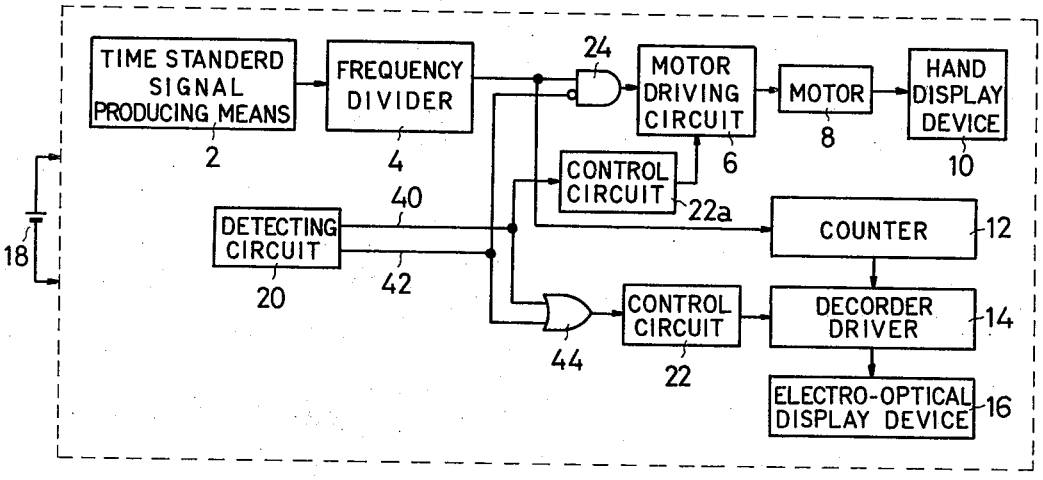

Referring to FIG. 5, the battery voltage detecting circuit 20 is adapted to produce a first detecting signal of high level on lead 40 at a predetermined higher detecting level of the battery voltage and to produce a second detecting signal on lead 42 at a predetermined lower detecting level. The first detecting signal is applied to the display pulse modulating control circuit 22a and to an OR gate 44 and the second detecting signal is applied to the inhibiter 24 and the OR gate 44. Accordingly, when the battery voltage reaches to the higher detecting level, the display pulse modulating circuit 22a and 22 are actuated by the first detecting signal respectively, to thereby modify displays in both display devices 10 and 16. When the battery voltage reaches to the lower detecting level, the inhibiter 24 is turned to the output inhibit state resulting in the stopping of the hand display and the modified display of the electro-optical display device 16 is continued.

Figure 6:
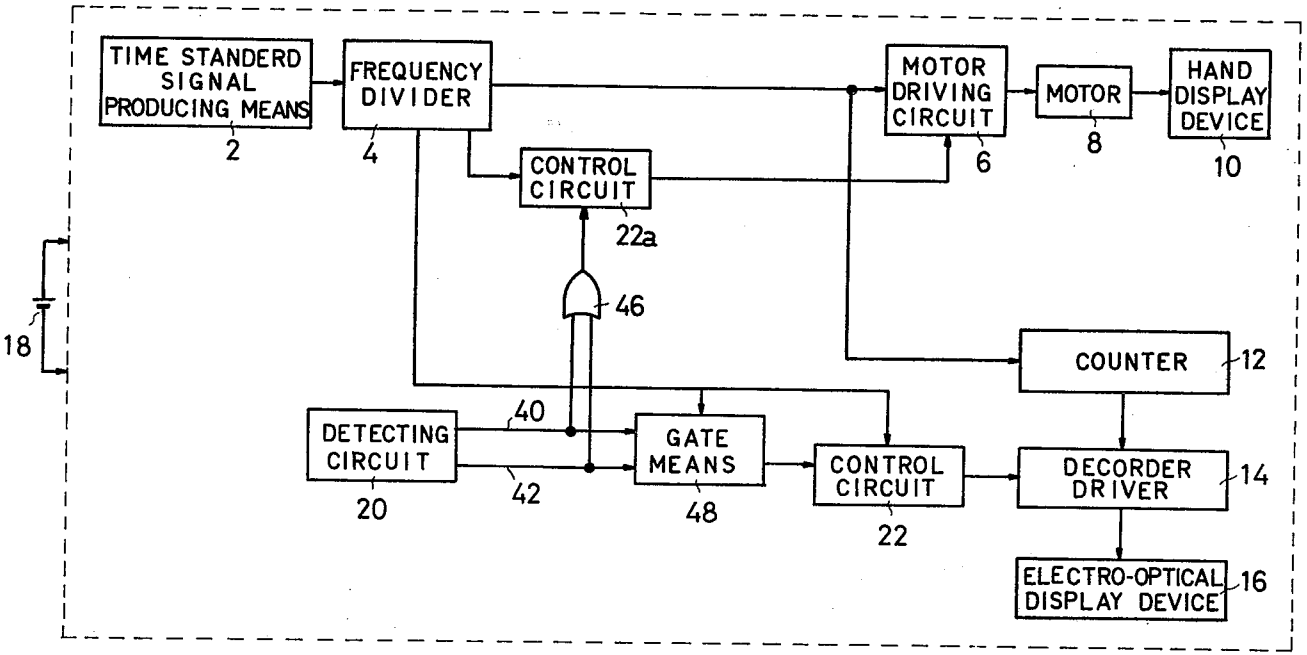
FIG. 6 is a block diagram of a further embodiment.

In the embodiment shown in FIG. 6, first and second detecting signals are applied to the display modulating control circuit 22a through an OR gate 46 and also to the display modulating control circuit 22 through a gate means 48. The gate means 48 is so arranged to produce a display modulating signal by the first detecting signal and to produce a display stopping signal by first and second detecting signals.

Therefore, when the first detecting signal generates, both displays are modified and when the second detecting signal generates on the lead 42, display in the electro-optical display device 16 disappear and display in the hand display device 10 is continued.

Although each embodiment of FIGS. 5 and 6 is designed to inform the end of the battery in both display devices 10 and 16 in response to the first detecting signal, it will be seen that only one of displays may be modified to inform the termination.

Figure 7:
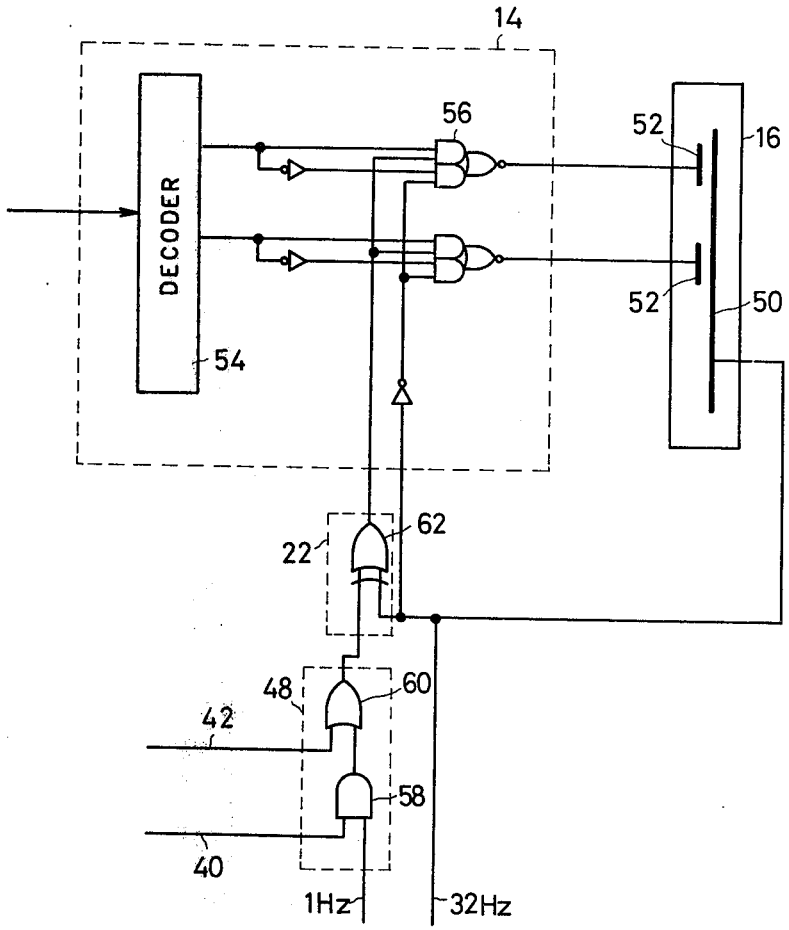
FIG. 7 is a circuit showing a decoder driver in the embodiment of FIG. 6.

FIG. 7 shows in detail the decoder driver 14, display pulse modulating control circuit 22, gate means 48, and the electro-optical display device 16 in the embodiment of FIG. 6. The electro-optical device 16 is a liquid crystal display device which comprises a common electrode 50 and a plurality of segments 52. For the convenience of description, two segments are illustrated in the figure. The decoder driver 14 comprises a decoder 54 and gate means 56, the decoder operates to convert the time signals applied from the counter 12 to segment signals. The gate means 48 comprises an AND gate 58 and an OR gate 60. 1 Hz pulse from the frequency divider 4 is applied to the AND gate 58 and 32 Hz pulse is applied to the common electrode 50 and to an exclusive OR gate 62 in the display pulse modulating control circuit 22.

When output on the lead 40 is "L", 32 Hz pulse is applied to the common electrode 50 and to the gate means 56 through the exclusive OR gate 62. The gate means 56 operates to convert the segment signals from the decoder 54 to the inverted 32 Hz pulse. Thus, the liquid crystal display device is actuated by the inverted pulses applied to the segments 52 and common electrode 50 to display the time. When the output on the lead 40 turns to "H", output of the AND gate 58 turns to 1 Hz pulse. The 1 Hz pulse is applied to the exclusive OR gate 62 via the OR gate 60, so that the output of the exclusive OR gate 62 turns to the signal which is inverted at 1 Hz. Therefore, display in the device 16 is flashed at 1 Hz to inform the decrease of the battery voltage. When output on the lead 42 turns to "H", the output of the exclusive OR gate 62 turns to inverted 32 Hz pulse. Therefore, the segment signal applied to each segment 52 is in phase with 32 Hz pulse applied to the common electrode 50. Accordingly, there is not voltage difference between the segment and the common electrode, which results in disappearance of the display.

As a modification of the embodiment of FIG. 6, the display pulse modulating control circuit 22a and the OR gate 46 may be omitted to inform the end of the battery lifetime by the electro-optical display device solely.

We claim,

1. A system for signaling the low voltage condition of a battery in an electronic timepiece, said system comprising:

display means for displaying time information, said display means including at least two time displays;

a battery voltage detector means which produces a first output when the battery voltage falls below a first predetermined value and produces a second output when the battery voltage falls below a second predetermined value;

modifying means responsive to said first and second output of said battery voltage detector for selectively modifying the appearance of one of said time displays in response to said first output to indicate that the battery voltage has fallen below said first predetermined value, said modifying means modifying the appearance of another of said time displays in response to said second output indicating that the battery voltage has fallen below said second predetermined value.

2. The system of claim 8 wherein one of said time displays is an electro-optical display and another one of said time displays is a motor driven hand display.

3. The system of claim 2 wherein said modifying means flashes said electro-optical display to indicate that the battery voltage has fallen below said first predetermined value.

4. The system of claim 2 wherein said modifying means alters the normal motion of said motor driven hand display to indicate that the battery voltage has fallen below said first predetermined value, said modifying means stopping the motion of said motor driven hand display when the battery voltage has fallen below said second predetermined value.

5. A system for signaling the low voltage condition of a battery in an electronic timepiece, said system comprising:

display means for displaying time information, said display means including at least two time displays;

a battery voltage detector means which produces a first and a second output when the battery voltage falls below a first and a second predetermined value, respectively;

means responsive to said first output of said battery voltage detector means for modifying the appearance of one of said time displays; and means responsive to the second output of said battery voltage detector for modifying the appearance of another of said time displays.

6. A system for signaling the low voltage condition of a battery in an electronic timepiece, said system comprising:

at least two operatively enabled time displays;

a battery voltage detector which produces an output when the battery voltage falls below a predetermined value;

means responsive to said output of said battery voltage detector for modifying the appearance of one of said time displays;

means responsive to said output of said battery voltage detector for turning off another of said time displays;

an alarm; and means responsive to the output of said battery voltage detector for inhibiting the operation of said alarm.

7. A system for signaling the low voltage condition of a battery in an electronic timepiece, said system comprising:

at least two time displays;

a battery voltage detector which produces a first output when the battery voltage falls below a first predetermined value and produces a second output when said battery voltage falls below a second predetermined value lower than said first predetermined value;

means responsive to said first output of said battery voltage detector for modifying the appearance of one of said time displays; and means responsive to said second output of said battery voltage detector for turning off the modified one of said time displays.

8. A system for signaling the low voltage condition of a battery in an electronic timepiece which produces time display information, said system comprising:

a motor driven hand display;

an electro-optical display;

a battery voltage detector means which produces a first and a second output when the battery voltage falls below a first and a second predetermined value, respectively;

signal modulation means for generating a periodic signal; and gate means responsive to said signal modulation means and to said first and second output of said battery voltage detector for pulsing said electro-optical display at the frequency of said periodic signal from said signal modulation means when said first output of said battery voltage detector is received, said gate means allowing said signal modulation means to modify the movement of the motor driven hand display in response to said second output of said battery voltage detector.

* * * * *

UNITED STATES PATENT AND TRADEMARK OFFICE

CERTIFICATE OF CORRECTION

PATENT NO. : 4,262,349

DATED : April 14, 1981

INVENTOR(S) : Sekiya et al

It is certified that error appears in the above—identified patent and that said Letters Patent is hereby corrected as shown below:

Before "[51] Int. Cl.$^3$ .... G04B 1/26; G04B 25/00"

insert the following:

-- [30] Foreign Application Priority Data

Dec. 7, 1977 [JP] Japan ..... 52-164265[U]

Dec. 7, 1977 [JP] Japan ..... 52-164266[U]

Dec. 15, 1977 [JP] Japan .... 52-151056 --

Signed and Sealed this

Fourth Day of May 1982

[SEAL]

Attest:

GERALD J. MOSSINGHOFF

Attesting Officer

Commissioner of Patents and Trademarks